US005325607A

United States Patent [19]

Weib et al.

[11] Patent Number: 5,325,607

[45] Date of Patent: Jul. 5, 1994

[54] REACTOR FOR DRYING WATER-CONTAINING SOLIDS IN A HEATED FLUIDIZED BED AND METHOD OF OPERATING THE REACTOR

[75] Inventors: Hans-Jürgen Weib, Oberursel; Wolfgang Frank, Eschborn; Wladyslaw Lewandowski, Schwalbach; Wolfgang Scheler, Bad Homburg, all of Fed. Rep. of Germany

[73] Assignee: Metallgesellschaft Aktiengesellschaft, Frankfurt, Fed. Rep. of Germany

[21] Appl. No.: 122,030

[22] Filed: Sep. 14, 1993

[30] Foreign Application Priority Data

Sep. 25, 1992 [DE] Fed. Rep. of Germany ..... 4232110

[51] Int. Cl.[5] ..... F26B 17/00

[52] U.S. Cl. ..... 34/586; 34/588; 34/593; 110/245; 432/58; 432/15

[58] Field of Search ..... 34/57 A, 10, 57 R; 110/245; 432/58, 15, 95

[56] References Cited

U.S. PATENT DOCUMENTS 2,412,057 12/1946 Nichols .
4,295,281 10/1981 Potter .
4,423,558 1/1994 Meunier ..... 432/58
4,797,142 1/1989 Jensen ..... 432/95
4,822,229 4/1989 Legille et al. ..... 34/95
5,243,767 9/1993 Stein ..... 34/57 A

FOREIGN PATENT DOCUMENTS 3644806 5/1988 Fed. Rep. of Germany .
3944366 10/1990 Fed. Rep. of Germany .

*Primary Examiner*—Henry C. Yuen
*Attorney, Agent, or Firm*—Sprung, Horn, Kramer & Woods

[57] ABSTRACT

A reactor for drying solids in a heated fluidized bed comprising over the fluidized bed a vapor-collecting space provided with a vapor outlet. Means for feeding the water-containing solids are provided over the vapor-collecting space. A conical distributor surface, which is rotatable about a vertical axis, is provided in the vapor-collecting space below the supplying means and slopes at an angle of 25° to 70° from the horizontal and is formed with at least one aperture. The aperture occupies 10 to 90% of the theoretical overall area of the distributor surface. The distributor surface is rotated at a speed of 20 to 250 revolutions per minute.

4 Claims, 1 Drawing Sheet

Figure 1:
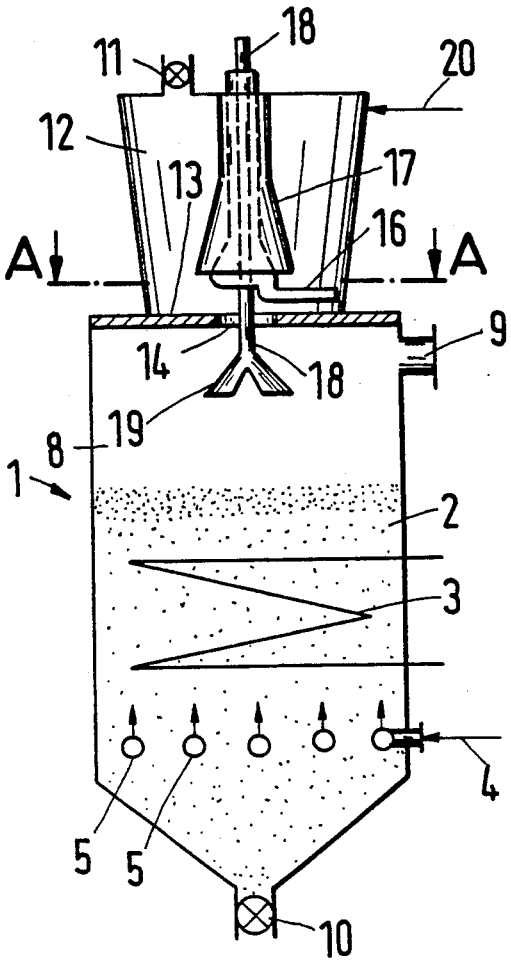

REACTOR FOR DRYING WATER-CONTAINING SOLIDS IN A HEATED FLUIDIZED BED AND METHOD OF OPERATING THE REACTOR

DESCRIPTION

This invention relates to a reactor for drying water-containing solids in a heated fluidized bed, which reactor comprises above the fluidized bed a vapor-collecting space provided with a vapor outlet and, above the vapor-collecting space, means for feeding the water-containing solids, and relates also to a method of operating the reactor.

Reactors of that kind are known and have been described, e.g., in German Patent 29 01 723 and the corresponding U.S. Pat. No. 4,295,281 and in German Patent 36 44 806 and DE-A-39 43 366. Such publications do not contain a discussion about how the water-containing solids, which preferentially form lumps as they are delivered, can be fed to the fluidized bed uniformly and in the finest possible state of division. U.S. Pat. No. 2,412,057 discloses a rotating disk for laterally throwing material to be dried in a lateral direction from a supply passage by centrifugal force.

It is an object of the invention so to design the reactor described hereinabove that the water-containing solids are distributed in the vapor-collecting space in such a manner that any relatively large lumps will be destroyed. At the same time, the solids should be distributed as uniformly as possible over the top surface of the fluidized bed.

This is accomplished in accordance with the invention in that an approximately conical distributor surface, which is rotatable about a vertical axis, is provided in the vapor-collecting space below the feeding means, slopes at an angle from about 25° to 70° from the horizontal and has at least one aperture which occupies about 30 to 90% of the theoretical overall area of the distributor surface.

The approximately conical distributor surface is not a closed surface but has one or more apertures, through which pass part of the solids which come from the distributor surface. Such solids which fall through the aperture or apertures are moved radially outwardly by the rotating distributor surface to a much smaller extent so that the central portion of the fluidized bed under the distributor surface can fairly uniformly be supplied with solids just as the outer portions. Nevertheless the distributor surface also constitutes a baffle by which particularly relatively large agglomerates formed by the solids falling from above are crushed.

The vapor-collecting space usually has a water vapor saturation of at least 80% and often of about 100%. Above the distributor surface that water vapor contacts the cold water-containing solids and condenses on the surface thereof. This will promote the formation of agglomerates; that formation is opposed by the rotating distributor surface. By choosing a suitable/rotational speed for the distributor surface it is possible to adapt the action of that surface to the objects to be accomplished in dependence on solids of a given kind. In most cases the speed lies in the range of about 20 to 250 revolutions per minute.

The granular solids to be dried may consist, e.g., of coal, brown coal, ores or sludges of various kinds.

The largest diameter of the distributor surface is preferably 0.1 to 0.4 times the diameter of the top surface of the fluidized bed. To improve the function of the distributor surface, i.e., to spread the solids as uniformly as possible over the fluidized bed and, at the same time, to intensify the crushing of the lumps, the top surface of the distributor surface member may be provided with projections which may consist, e.g., of humps, teeth or ribs.

Figure 3:
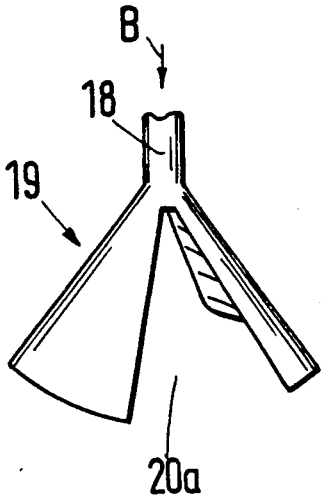
Figure 4:
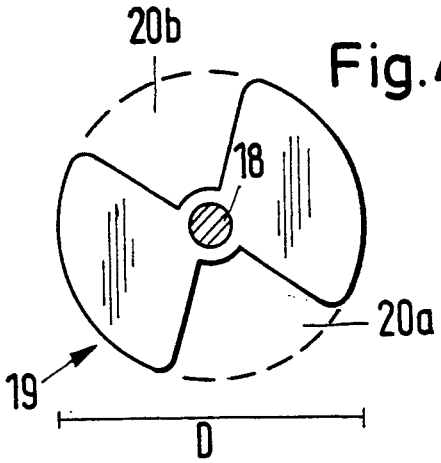
Figure 2:
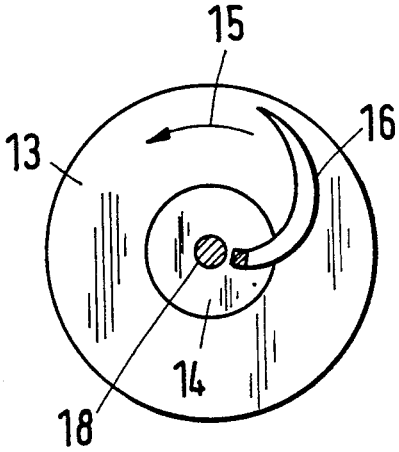
Figure 5:
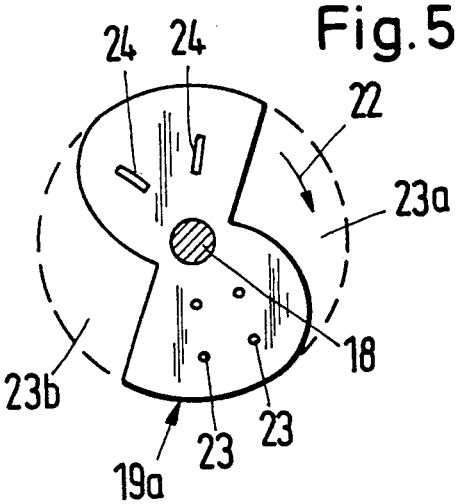

Optional further features of the reactor and details of its operation will be explained with reference to the drawing, in which FIG. 1 is a schematic longitudinal sectional view showing the reactor, FIG. 2 is a sectional view taken on line A—A in FIG. 1 and showing the supply chamber, FIG. 3 is a perspective view showing a first embodiment of the distributor surface, FIG. 4 is a top plan view showing the distributor surface of FIG. 4 viewed in the direction of the arrow B, and FIG. 5 is a top plan view showing a further embodiment of the distributor surface.

The reactor 1 is used to dry water-containing solids in a fluidized bed 2, which is indirectly heated by heat exchanger means 3. Superheated steam is preferably used as a fluidizing fluid and is supplied through line 4 and conducted into the fluidized bed 2 through a grate 5, which is constituted, e.g., by horizontal tubes and formed with orifices. The water vapor formed as a result of the drying is collected together with the fluidizing fluid in the vapor-collecting space 8 over the fluidized bed 2. The atmosphere which is rich in water vapor is withdrawn through the vapor outlet 9. Substantially dry solids are taken through a metering lock chamber 10 from the lower end of the reactor 1.

The solids to be dried are supplied through an inlet lock chamber 11 into a supply chamber 12, which in its bottom 13 has an outlet opening 14; see also FIG. 2. A crescent-shaped pusher 16 is moved over the bottom 13 in the direction indicated by the arrows 15 to push the solids to the outlet 14. Spaced above the outlet 14 is a rigid conical shield 17; see FIG. 1, which prevents solids from the supply chamber 12 from falling down freely through the outlet 14. An approximately conical distributor surface 19 is secured to the bottom end of a vertical shaft 18, which extends through the outlet 14. In a manner known per se, not shown, the distributor surface 19 can be driven at a controllable speed about a vertical axis by means of the shaft 18, which extends to the outside. The rotational movement of the distributor surface 19 is independent of the motion of the crescent-shaped pusher 16, with which separate drive means, not shown, are associated.

In order to prevent a disturbing rise of vapors rich in water vapor from the vapor-collecting space 8 through the outlet 14 into the supply chamber 12, air or nitrogen, for example, may be supplied through line 20 in order to maintain in the chamber 12 a pressure which is approximately as high as the pressure in the vapor-collecting space 8.

The water-containing solids which have been moved to the outlet 14 by the crescent-shaped pusher 16 fall down and impinge on the rotating distributor surface 19. As a result, agglomerates formed by the solids are crushed. The distributor surface 19 is so shaped that the solids are distributed as uniformly as possible over the top surface of the fluidized bed 2.

A possible form of the distributor surface 19 is shown in FIGS. 3 and 4. FIG. 3 is a perspective view and FIG.

4 a top plan view taken in the direction indicated by the arrow B in FIG. 3. The conical distributor surface 19 has two apertures 20*a* and 20*b* so that the surface 19 is partly apertured. In practice, the shape of such apertures may be varied in a wide range or the distributor surface may have only one aperture or several apertures. Without such apertures the largest diameter of the distributor surface 19 would describe a circle; see FIG. 4 where that circle is indicated by broken lines adjacent to the apertures 20*a* and 20*b*. The resulting closed circle defines the theoretical overall area of the distributor surface. In that theoretical overall area the apertures are not taken into account. The area of the apertures is 30 to 90% of the theoretical overall area of the distributor surface 19. The area and shape of the apertures 20*a* and 20*b* may be chosen within a wide range so that the design of the distributor surface can be adapted to different functions. The largest diameter D of the distributor surface 19, see FIG. 4, is usually 0.1 to 0.4 time the diameter of the top surface of the fluidized bed 2.

FIG. 5 shows a somewhat different embodiment of the distributor surface 19*a*, which is preferably rotated in the direction indicated by the arrow 22 about the vertical shaft 18. The apertures 23*a* and 23*b* are defined on the outside by the broken circular line, which defines the largest diameter. For that distributor surface 19*a* it is also shown that the top surface of the distributor surface member may be provided, e.g., with humps 23 or ribs 24 in order to intensify the crushing of lumps of solids as the surface 19*a* is rotated and to influence the course of the solids. Such projections can be used to improve the uniform distribution of the solids on the fluidized bed 2.

It will be appreciated that the instant specification and claims are set forth by way of illustration and not limitation, and that various modifications and changes may be made without departing from the spirit and scope of the present invention.

We claim:

1. In a reactor for drying water-containing solids in a heated fluidized bed, which reactor comprises said fluidized bed and above the fluidized bed a vapor-collecting space provided with a vapor outlet and, above the vapor-collecting space, means for feeding the water-containing solids through an outlet opening downward to the fluidized bed, an approximately conical distributor surface, which is rotatable about a vertical axis, is provided in the vapor-collecting space below said outlet opening, said surface sloping at an angle from about 25° to 70° from the horizontal and having at least one aperture which occupies about 30 to 90% of the theoretical overall area of the distributor surface.

2. A reactor according to claim 1, wherein the largest diameter of the distributor surface is 0.1 to 0.4 time the diameter of the top surface of the fluidized bed.

3. A reactor according to claim 1, including projections provided on the top surface of the distributor surface.

4. A method of operating a reactor according to claim 1, which comprises rotating the distributor surface at a speed of about 20 to 250 revolutions per minute.

* * * * *

UNITED STATES PATENT AND TRADEMARK OFFICE

CERTIFICATE OF CORRECTION

PATENT NO. : 5,325,607

DATED : July 5, 1994

INVENTOR(S) : Weiss, et al.

It is certified that error appears in the above-identified patent and that said Letters Patent is hereby corrected as shown below:

| | |
|---|---|
| Title Page | Line 2 delete " Weib et al. " and substitute -- Weiss et al. -- |
| Title Page | U.S. PATENT DOCUMENTS: After " 4,423,558, 1/ " delete " 1994 " and substitute -- 1984-- |
| Title Page | FOREIGN PATENT DOCUMENTS: Delete " 3944366 " and substitute -- 3943366 -- |

Signed and Sealed this

Twenty-fifth Day of October, 1994

*Attest:*

Bruce Lehman

BRUCE LEHMAN

*Attesting Officer*

*Commissioner of Patents and Trademarks*